US006637966B2

(12) United States Patent
Roberts

(10) Patent No.: US 6,637,966 B2
(45) Date of Patent: Oct. 28, 2003

(54) SEALABLE TOILETRY ARTICLE

(76) Inventor: Keith Roberts, 48 Maple La., Little Canada, MN (US) 55117

( * ) Notice: Subject to any disclaimer, the term of this patent is extended or adjusted under 35 U.S.C. 154(b) by 10 days.

(21) Appl. No.: 10/113,584

(22) Filed: Mar. 29, 2002

(65) Prior Publication Data

US 2002/0146274 A1 Oct. 10, 2002

Related U.S. Application Data

(60) Provisional application No. 60/281,739, filed on Apr. 6, 2001.

(51) Int. Cl.[7] ..... B43K 23/08
(52) U.S. Cl. ..... 401/213
(58) Field of Search ..... 401/202, 213, 401/214, 262, 269, 245, 246; 215/341, 345, 346; 222/562

(56) References Cited

U.S. PATENT DOCUMENTS

| | | | | | |
|---|---|---|---|---|---|
| 2,749,566 | A | | 6/1956 | Thomas | 15/132.7 |
| 2,923,957 | A | | 2/1960 | Gentile | 15/132.7 |
| 2,998,616 | A | | 9/1961 | Gentile | 15/572 |
| 4,030,844 | A | * | 6/1977 | Lench et al. | 401/213 |
| 4,050,826 | A | | 9/1977 | Berghahn et al. | 401/196 |
| 4,139,311 | A | * | 2/1979 | Lorscheidt | 215/341 |
| 5,073,057 | A | | 12/1991 | Lathrop et al. | 401/206 |
| 5,888,009 | A | * | 3/1999 | Toyama | 401/213 |

* cited by examiner

*Primary Examiner*—Tuan N. Nguyen
(74) *Attorney, Agent, or Firm*—Jacobson & Johnson

(57) ABSTRACT

An ectosealed toiletry dispensers which is applicable to toiletries, roll-on antiperspirants in particular, that are applied to the human axilla. A cap, an applicator such as a roll-on ball and a resilient sealing ring that seals between a shoulder of the container and an annular lip of the cap to provide an ectoseal. The sealing ring has sufficient durometer to conform to mold flashings as well as other molding irregularities. Securing the cap to the body with the ectoseal sandwiched between the container and the cap allows one to create a fluid tight seal that is maintainable under high pressure differential conditions to prevent liquid or air from escaping from the container.

18 Claims, 2 Drawing Sheets

SEALABLE TOILETRY ARTICLE

CROSS REFERENCE TO RELATED APPLICATIONS

This application claims priority from my provisional application S No. 60/281,739 filed Apr. 6, 2001 titled Hermetic Sealing Mechanism.

FIELD OF THE INVENTION

This invention relates to toiletry dispensers and more specifically to a hand sealable toiletry dispenser that incorporates a flexible seal to prevent leakage of the contents in the event the pressure outside the container exceeds the internal pressure in the container.

STATEMENT REGARDING FEDERALLY SPONSORED RESEARCH OR DEVELOPMENT

None

REFERENCE TO A MICROFICHE APPENDIX

None

BACKGROUND OF THE INVENTION

The concept of toiletry dispensers is well known in the art with toiletry dispensers available in multiple types and forms. Typically, toiletry dispensers, which are throw away items, are injection molded from plastic. During there use toiletry dispensers are carried with the user as the user travels from one place to another. One of the difficulties with transporting toiletry dispensers in aircraft is that the toiletry dispenser sealing mechanisms are generally ineffective to prevent the toiletry from oozing from the container when the atmospheric pressure drops.

The present invention addresses the problem associated with the differential pressure between the inside of the container and the outside the container. Typically, the pressure inside the container is one atmosphere at sea level and the pressure on the outside of the container at sea level is also one atmosphere and therefore if the container is opened and closed at sea level, the differential pressure is zero. By placing a sealed container in a luggage compartment on an airplane the toiletry dispenser is subject to external air pressures associated with altitudes of 30,000 feet or more. For example, at an altitude of 30,000 feet the air pressure is approximately 1/4 atmosphere. If the container is in a closed condition this creates a substantial differential pressure between the outside of the container and the inside of the container.

With existing toiletry dispensers the differential pressure between the inside of the container and the outside container approaches equilibrium as the air within the container seeps out. The air seepage is generally not a problem if the container is right side up or even lying on its side. However, if the container is not in an upright condition the higher pressure air from the inside of the bottle is sucked out together with the toiletry causing leakage of the toiletry over articles that may be proximate the toiletry dispenser.

The Lathrop, et al, U.S. Pat. No. 5,073,057 mentions the problems that are associated with dispensing of liquid roll-on anti perspirants and deodorants. Lathrop points out the use of a capillary device 20 to relieve pressure differential conditions to prevent liquid from running down the side of the container. In his abstract he points out he has a "Device for applying liquid materials to the skin, said device having a liquid container, a poromeric plastic applicator head, and a diaphragm spring holding the applicator in said device. The diaphragm spring provides a liquid tight seal between the poromeric applicator head and the liquid container and also allows movement of the poromeric applicator head in a vertical direction to create a pressure within the liquid container and provide force to aid in moving the liquid through the poromeric applicator head to its outer surface. The poromeric applicator head is also provided with a capillary pressure compensating value To maintain substantially equal pressure within and without the dispensing container". Thus Lathrop seeks to solve the problem of liquid running out of the container by using a capillary valve to equalize the pressure inside and outside the container.

Other referenced patents such as Thomas U.S. Pat. Nos. 2,749,566 address the problem of leakage in a different manner. Thomas discloses an internal seal that extends around his ball dispenser with the sealing arrangement forming a horizontal compression of his seal against the spherical surface of his ball.

A similar type of internal sealing arrangement is shown in Gentile U.S. Pat. No. 2,923,957 where he provides a seal between his ball and a lateral sealing surface. Gentile discloses a sealing member and skirt which are brought into the gap between the ball and the housing to seal the ball.

Other prior art internal sealing mechanisms are known, for example Berhhaahn U.S Pat. No. 4,050,826 shows a sealing flange 13 and a neck 7, where the flange is an integral part of the molded plastic body. Berhhaahn points out that he has a "sealing surface 23 that is designed to form a tight seal" when his screw cap abuts against the upper surface of his flange. However, he does not state that his device produces a hermetic seal or a fluid tight seal. In fact, because of the manner of manufacture of toiletry dispensers the formation of a fluid tight seal between the inside of the container and the outside of the container is both difficulty and costly to achieve.

In general, a conventional roll-on applicator for toiletry articles includes a body, a cap and a roll-on ball. The body of these containers usually contains a male thread on the body and the cap that contains a female mating thread. The prior art devices for sealing conventional toiletry articles having containers and caps generally uses the engaging relationship between the male and female threads to provide a seal. Unfortunately, the threads used in toiletry caps and containers are molded and as a result lack the necessary tolerances to form leakproof seals therebetween. Thus the tolerances resulting from the molding process are inadequate to create a hermetic or fluid-tight seal between the cap and the container that would prevent the container from leaking if taken to high altitude conditions.

In addition to tolerance problems, the containers and caps, which are made of plastics, have shrink rates associated with the plastic. Those skilled in the art of injection molding understand that plastics shrink as the mold cools and can often deform from the intended shape. Consequently, when a injection molded plastic body and an injection molded plastic cap are tightened, the mating threads can contain deformities and therefore it is difficult to create a hermetic or fluid-tight seal therebetween. Also, because of the injection molding process even if a rigid cap and rigid container abut against each other, the abutting rigid surfaces can contain flashings or other molding irregularities so that one cannot create a surface to surface seal between the rigid cap and a rigid flange of the container.

Lathropi, et al, mentions the importance of maintaining equal pressure within and without the dispensing container.

In contrast, the present invention maintains the air pressure within the container by providing an ectoseal that forms a fluid tight seal between a sealing surface on the cap and a sealing shoulder or the container. The sealing surface on the cap and the sealing shoulder on the container are drawn onto opposite sides of a sealing ring that extends around the periphery of the container.

The fact that because one cannot form a hermetic or fluid tight seal at sea level does not necessarily present a problem unless the container is positioned in a non upright condition. However, it is beneficial to the chemicals in the toiletries, in particular, aluminum chloride hexahydrate, and the like if one can keep the atmospheric moisture from reacting with the aluminum chloride hexahydrate, as water can alter the pH of the aluminum chloride hexahydrate into an undesirable acid level and, therefore, cause skin irritation. Therefore sealing out the moisture from the inside of the container can be beneficial to the toiletry.

In general, the prior art toiletry dispensers with a threaded cap secured to the body of a container fail to address differential pressures between the interior of the container and the exterior of the container that occur at high altitudes, particularly at altitudes of 30,000 feet or more. The present invention provides an effective, efficient dispenser that obviates the problem of leakage at high altitudes.

The present invention also provides benefit at sea level. For example, should the toiletries or antiperspirants therein be shipped during periods of extreme heat, the internal pressure created from the heat can force the toiletries out of the container. This problem is particularly acute if the container is inverted as the higher pressure in the container can force the liquid out of the bottle, resulting in loss of toiletries and contamination of packaging. The present invention forms a fluid tight ectoseal that prevents air or liquids from oozing out or the container.

In addition, the present invention can prevent excessive atmospheric moisture from entering the container thus reducing the opportunity for the contents to react with the moisture in the atmosphere.

A further advantage of the present invention is that the condition of the ectoseal can easily be observed by a user to thereby provide a visual indication regarding the sealing status of the toiletry dispenser.

SUMMARY OF THE INVENTION

The present invention comprises an ectoseal providing a hermetic seal mechanism or fluid tight seal that is applicable to toiletries, roll-on antiperspirants in particular, that are applied to the human axilla. Toiletry dispensers usually have a threaded cap, a bottle or container with mating threads and a toiletry applicator such as a roll-on ball. In the present invention a resilient ectoseal seal is located between a circumferential shoulder of a container and an annular lip of the threaded cap. The resilient ectoseal has sufficient durometer to conform and seal around mold flashings as well as other molding irregularities. Securing the cap to the body with the ectoseal sandwiched between the container and the cap allows one to create a fluid tight seal that is maintainable under high pressure differential conditions to prevent liquid or air from escaping from the container while the container undergoes low pressure conditions.

DESCRIPTION OF THE PREFERRED EMBODIMENT

Figure 1:
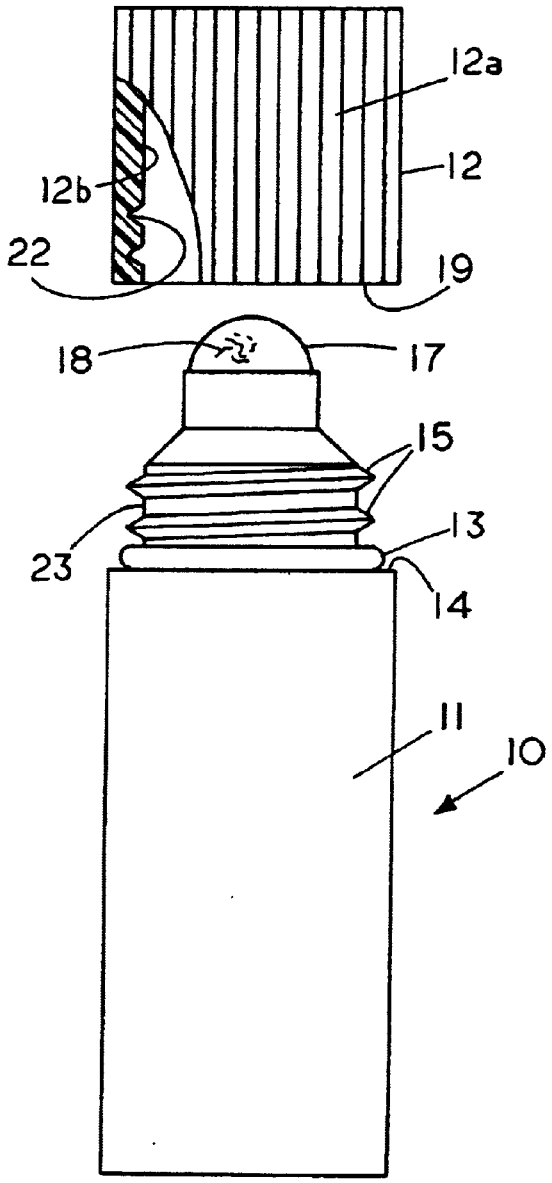
FIG. 1 is an exploded view of a toiletry dispenser.

FIG. 1 is an exploded view of a toiletry dispenser 10 comprising a cylindrical container 11 having a first set of male threads 15 thereon. An annular peripheral shoulder 14 extends circumferentially around container 11 with the annular peripheral shoulder 14 spaced from a top end or bottom end of container 11. Toiletry dispenser 10 generally includes a liquid type toiletry 18 which can flow out of the dispenser if the pressure inside the container is greater than the pressure outside the container. The toiletry is located in container 11 and is also shown located on a ball type applicator 17 for roll dispensing the liquid type toiletry 18 onto a persons body.

Located on the annular peripheral shoulder 14 of container 11 is a resilient sealing ring 13. The resilient sealing ring 13, which can be an O-ring or the like, is supported in an axial direction by shoulder 14 which extends radially inward to a container wall 23. Sealing ring 13 is held in a coaxial position with container 11 by a cylindrical side wall 23 of container 11.

A cylindrical cap 12 shown partially in section is securable to container 11. Cap 12 is shown having a set of external ridges 12*a* thereon for ease in grasping or holding cap 12 as it is secured to container 11. A set of female threads 22 are located on the interior wall 12*b* of cap 12.

The preferred sealing ring is a Parker 2-227 O-ring manufactured by Buna. The preferred plastic for the bottle and the cap is polyethylene. Gaskets may be used in addition to silicone sealant or any other mechanism which could create an integral seal between the body and the cap of the roll-on container. The O-ring seals are well known in the art and are conventionally used in industrial and commercial applications to seal equipment such as valves or the like.

Figure 2:
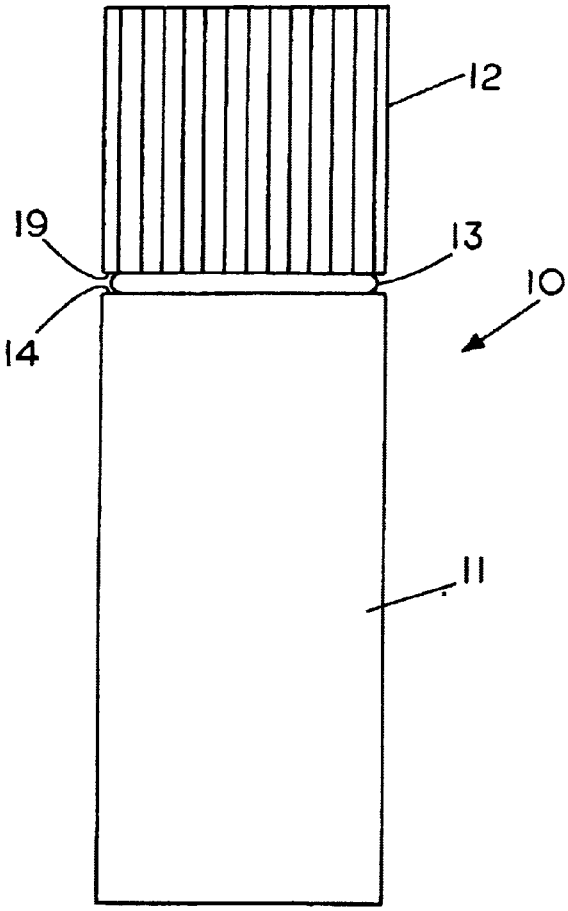
FIG. 2 is an assembled view of the toiletry dispenser of FIG. 1.

FIG. 2 is an assembled view of the toiletry dispensers of FIG. 1 showing cap 12 having annular lip 19 located in 360 degree pressure engagement with a top side of sealing ring 13 and annular peripheral shoulder 14 located in 360 degree pressure engagement with the bottom side of sealing ring 13 to hermetically seal an interior of the container 11 that carries the toiletry from the exterior of container 11. By removing the sealing region from the interior of the toiletry dispensers and providing an ectoseal one can generate high compression forces on the sealing ring by rotation of cap 12 onto container 11. In addition by having an ectoseal it prevents any toiletry that may be on the ball dispenser from leaching out since the internal pressure of the entire container is maintained at the same pressure.

FIG. 1 shows cap 12 includes a set of female threads 22 for forming mating engagement with the male threads 15 on container 11. Cap 12 has an outer peripheral annular lip 19 forming a radial lateral sealing surface so that when cap 12 is threadingly engaged with container 11 the rotation of cap 12 about container 11 axially compress the sealing ring 13 between the annular peripheral shoulder 14 and the annular lip 19 to form a leak proof seal between the interior of the container and the exterior of the container thereby preventing the toiletry 18 located in container 11 from escaping from the container in the event of air pressure outside the container falls below the air pressure inside the container.

In the embodiments shown the sealing surfaces of the cap 12 and container 11 are located at the external peripheral junctions of the cap 12 and the container 11 to seal the interior of the container and cap from the exterior of the cap and container and thereby provide an ectosealing arrangement. It is preferred that the sealing ring has a sufficiently small internal diameter that the sealing ring engages the container wall 23 so as to frictionally secure the sealing ring 13 to the container 11 thereby allowing the sealing ring 13 remain on the container as the cap 12 is removed from the container. As a result the sealing ring 13 remains in a ready condition for sealing so that all the user needs to do is to screw the cap on the container.

Figure 3:
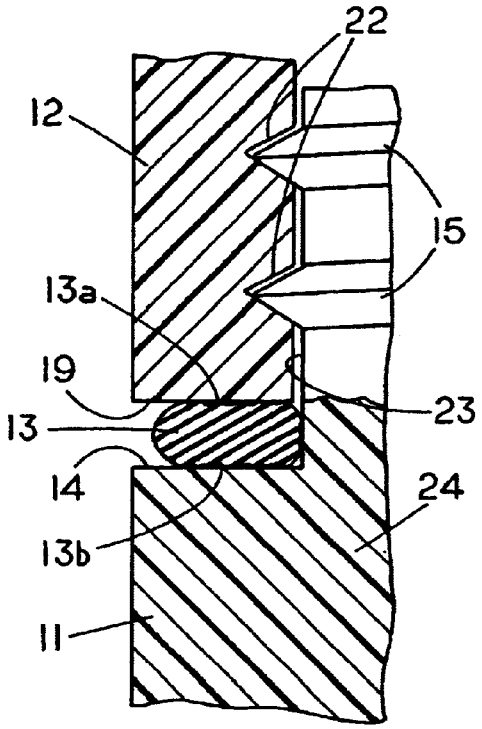
FIG. 3 is a detail view of the shoulder on the container supporting a sealing ring therein which is compressed by an annular lip on the cap.

FIG. 3 is a detail view of the shoulder 14 on the container 11 supporting a sealing ring 13 therein which is compressed by an annular lip 19 on cap 12. The annular lip 19 comprises a sealing surface that engages the top side 13*a* of sealing ring 14. Similarly, the shoulder sealing surface 14 engages the lower side of sealing ring 13 at region 13*b*. In the embodiment shown the axial pressure created by the threaded engagement of threads 21 and 22 allows one to compressively squeeze the sealing ring between lip 19 and shoulder surface 14. In the embodiment of FIG. 3 the sealing surface 19 and the shoulder surface 14 are located in a parallel condition to each other. In this condition the sealing ring is held in a centered condition around the container by the outer cylindrical wall 23 thereby ensuring 360 degree contact with the lip 19 and shoulder surface 14. It will be appreciated that with the ectoseal formed by cylindrical sealing relationship between the end of the cap and the shoulder of the container allows one to maintain the internal pressure within the container.

Figure 4:
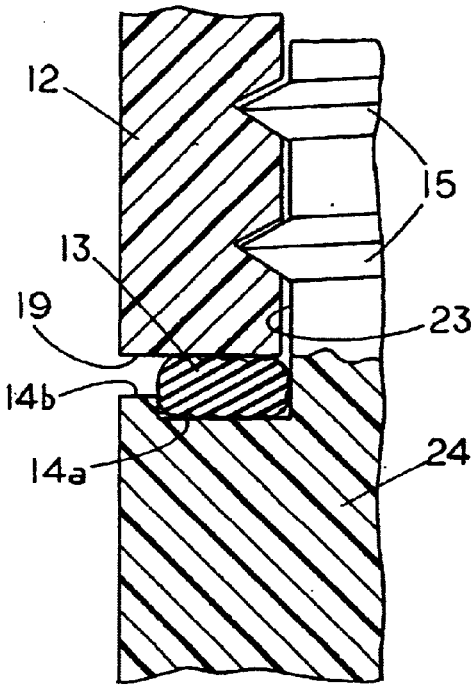
FIG. 4 is a detail view of an alternate embodiment wherein the shoulder has a recess for supporting a sealing ring therein which is compressed by an annular lip on the cap.

FIG. 4 is a detail view of an alternate embodiment wherein the shoulder 14 has an annular recess 14*a* for supporting a sealing ring 13 therein which is compressed by an annular lip 19 on cap 12. This embodiment is suitable for the softer types of sealing rings since the annular ridge 14*b* which extends around the shoulder 14 provides a physical barrier that resists the seal being dislodged by the internal pressure in the container. In the embodiment shown the sealing ring 13 is positioned at a circumferential terminus region of the cap so as to prevent flow of fluid past the circumferential terminus region of the cap.

Figure 5:
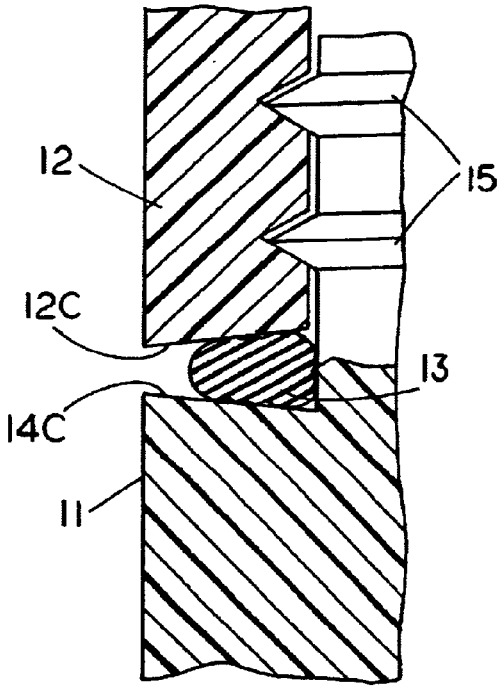
FIG. 5 is a detail view of a further alternate embodiment wherein the shoulder on the container and the annular lip on the cap form a tapered enclosure for retaining the sealing therein as the container is compressed by an annular lip on the cap.

FIG. 5 is a detail view of a further alternate embodiment wherein the shoulder 14*c* on the container forms an acute angle with the cylindrical wall of container 11 and the annular lip surface 12*c* forms an acute angel with the exterior cylindrical wall of cap 12. In this embodiment the two surface coact to form an annular tapered enclosure for retaining the sealing therein as the container is compressed by an annular lip on the cap. Although both surfaces are provided with surfaces that radially diverge toward the center of the container 11 it is envisioned that if only one of the surfaces diverged as it extended radially inward an annular tapered enclosure could be formed that confines the sealing ring therein to prevent radial outward displacement thereof.

The ectoseal addresses a considerable problem caused by conventional roll-ons and their containers with threaded caps and bodies.

TEST RESULTS

In order to confirm the effectiveness of the present invention a test fixture was used to test the invention. A gas vacuum pump was connected to a vacuum chamber comprised of a clear PVC shell, end caps and a vacuum gauge that has been threaded into the top of the vacuum chamber. The chamber also includes a needle valve to control the vacuum pressure inside the chamber. The test samples were inserted upside down into the vacuum chamber and the chamber sealed. A series of six tests were conducted using three different samples of the invention using the ectoseal and three different samples of a roll-on antiperspirant bottle without an o-ring seal. The vacuum pump was turned on and the needle valve was set so that the vacuum inside the chamber was reduced to ¼ of an atmosphere. The first three tests were conducted on the three control samples without the o-ring seal. Leakage was observed almost immediately.

For the test with the samples of the present invention, the pump was left running continuously for 30 minutes and the samples were observed for leakage. After 30 minutes no fluid had leaked from the samples of the present invention.

In the embodiments shown the sealing ring is left exposed to provide a visual indicator of the presence of the sealing ring. If desired a circumferential lip could be extended over the sealing ring to partially obscure or totally obscure the presence of the sealing ring.

I claim:

1. A molded plastic ectosealed toiletry dispenser comprising;

a container, said container including a first set of threads thereon;

a liquid toiletry located in said container;

a ball applicator located on said container for dispensing the liquid toiletry;

an annular peripheral shoulder extending around said container, said annular peripheral shoulder spaced from an end of said container;

a resilient sealing ring located on said annular peripheral shoulder, said resilient sealing ring supported in an axial direction by said shoulder and in a radial direction by a container wall;

a cap, said cap having a second set of threads for forming mating engagement with said first set of threads, said cap having a peripheral annular lip at an opened end thereon so that when said cap is threadingly engaged with said container the rotation of said cap about said container axially compress the resilient sealing ring between said annular lip and said annular peripheral shoulder to form a leak proof seal between an interior of the container and an exterior of the container to thereby prevent the toiletry located in said container from escaping therefrom in the event of air pressure outside the container falls below the air pressure inside the container.

2. The toiletry dispenser of claim 1 wherein the shoulder extends perpendicularly radially inward and the annular lip extends perpendicularly radially inward.

3. The toiletry dispenser of claim 1 wherein the shoulder forms an acute angle with the sidewall of the container to prevent the sealing ring from being forced radially off said shoulder when said cap is axially secured to said container.

4. The toiletry dispenser of claim 1 wherein the shoulder includes an annular recess for restraining said sealing ring from a radial outward displacement when the annular lip of the cover is squeezed against said sealing ring.

5. The toiletry dispenser of claim 1 wherein the annular lip on the end cap includes a sealing surface locate at an acute angle to an exterior wall of said container to prevent the sealing ring from being forced off said shoulder when said cap is axially secured to said container.

6. The toiletry dispenser of claim 1 wherein both the toiletry dispenser cap and the toiletry dispenser container are injection molded plastic.

7. The toiletry dispenser of claim 1 wherein the resilient seal comprises an elastomeric material of sufficient durometer so as to compress into a fluid tight seal when axially squeezed.

8. The toiletry dispenser of claim 1 wherein at least a portion of the resilient seal is visible around the exterior of the toiletry to provide a visual indication that the toiletry dispensers is in a sealed condition.

9. A toiletry dispenser comprising;

a container includes a roll-on ball;

a dispensable toiletry located in said container;

an annular peripheral shoulder extending around said container, said annular peripheral shoulder extending radially inward to form a first sealing surface;

a resilient sealing ring located on said seat, said resilient sealing ring supported in an axial direction by said first sealing surface;

a cap, said cap forming mating engagement with said container so that when said cap is engaged with said container an annular lip at an opened end of said cap axially compress the resilient sealing ring between said annular lip and said annular peripheral shoulder to form a leak proof seal between an interior of the container and an exterior of the container to thereby prevent the toiletry located in said container from escaping therefrom in the event of air pressure outside the container falls below the air pressure inside the container, wherein the sealing ring is positioned at a circumferential terminus region of the cap and the dispensable toiletry comprises a liquid.

10. The toiletry dispenser of claim 9 wherein the resilient sealing ring comprises an elastomer.

11. The toiletry dispenser of claim 10 wherein the sealing ring includes a retaining lip to prevent over tightening of the cap and the container.

12. The toiletry dispenser of claim 10 wherein the sealing ring comprises an elastomer material.

13. The toiletry dispenser of claim 12 wherein the cap and the container comprises a polymer plastic.

14. The toiletry dispenser of claim 13 wherein the sealing ring is frictionally secured to the container to remain on the container as the cap is removed from the container.

15. The toiletry dispenser of claim 14 wherein the shoulder extends 360 degrees around the container.

16. The toiletry dispenser of claim 15 wherein the sealing ring has an outside diameter smaller than the diameter of the container but larger than the diameter of the threads.

17. The toiletry dispenser of claim 14 wherein the sealing ring forms a decorative band around the toiletry dispenser.

18. The toiletry dispenser of claim 17 wherein the sealing ring forms a cushion to limit the axial displacement of said cap with respect to said container.

* * * * *